US006622674B2

(12) United States Patent
Kobayashi et al.

(10) Patent No.: US 6,622,674 B2
(45) Date of Patent: Sep. 23, 2003

(54) VALVE TIMING CONTROL SYSTEM FOR INTERNAL COMBUSTION ENGINE

(75) Inventors: Yoshiyuki Kobayashi, Kanagawa (JP); Shigeaki Yamamuro, Kanagawa (JP); Naotaka Nakura, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/201,998

(22) Filed: Jul. 25, 2002

(65) Prior Publication Data

US 2003/0034000 A1 Feb. 20, 2003

(30) Foreign Application Priority Data

Aug. 15, 2001 (JP) ..... 2001-246382

(51) Int. Cl.[7] ..... F01L 1/34

(52) U.S. Cl. ..... 123/90.15; 123/90.17; 123/90.31; 251/129.01; 464/1

(58) Field of Search ..... 123/90.15, 90.16, 123/90.17, 90.18, 90.27, 90.31; 251/129.01, 129.15, 129.16; 74/568 R; 464/29, 1, 2

(56) References Cited

U.S. PATENT DOCUMENTS

| | | | | | |
|---|---|---|---|---|---|
| 4,754,727 | A | * | 7/1988 | Hampton | 123/90.15 |
| 5,067,450 | A | * | 11/1991 | Kano et al. | 123/90.17 |
| 5,518,092 | A | * | 5/1996 | Ma | 192/41 R |
| 5,785,018 | A | * | 7/1998 | Schebitz | 123/90.17 |

FOREIGN PATENT DOCUMENTS

| | | | | | |
|---|---|---|---|---|---|
| JP | 03050308 | A | * | 3/1991 | F01L/1/34 |
| JP | 10-103114 | | | 4/1998 | |
| JP | 2001041013 | A | * | 2/2001 | F01L/1/34 |

* cited by examiner

*Primary Examiner*—Thomas Denion
*Assistant Examiner*—Ching Chang
(74) *Attorney, Agent, or Firm*—Foley & Lardner

(57) ABSTRACT

A valve timing control system includes a driving plate coupled to a crankshaft, a lever shaft coupled to a camshaft, a VTC housing, and an electromagnetic coil mounted to the VTC housing for producing a magnetic field to control a mounting angle formed between the driving plate and the lever shaft. The electromagnetic coil has rotation restricted and axial displacement allowed by the VTC housing, and is engaged with the lever shaft to enable rotation with respect thereto and axial displacement together therewith.

13 Claims, 8 Drawing Sheets

VALVE TIMING CONTROL SYSTEM FOR INTERNAL COMBUSTION ENGINE

BACKGROUND OF THE INVENTION

The present invention relates to a valve timing control system for an internal combustion engine, which performs variable control of opening and closing timing of an intake or exhaust engine valve in accordance with the engine operating conditions.

Typically, the valve timing control system controls opening and closing timing of an engine valve by controlling the phase of rotation of a crankshaft and a camshaft on a power transfer path from the crankshaft to the camshaft. Specifically, the system comprises a driving rotator coupled to the crankshaft through a timing chain and the like, a follower rotator coupled to the camshaft and to which the driving rotator is mounted to enable relative rotation as required, and a mounting-angle control mechanism interposed between the two rotators to control a mounting angle formed therebetween. Operating-force providing means provide an operating force to the mounting-angle control mechanism when required to change the phase of rotation of the crankshaft and the camshaft.

As for the operating-force providing means which include a hydraulic mechanism typically, various electromagnetic mechanisms have been developed in recent years. Some valve timing control systems using an electromagnetic force in the operating-force providing means include an electric motor unit between the driving rotator and the follower rotator. However, since an electromagnetic coil of the motor unit should integrally be mounted to one of the driving rotator and the follower rotator, the systems need a slip ring having insecure durability for energization of the coil, and are susceptible to torque variation due to increased inertia force of the rotators.

JP-A 10-103114 discloses a valve timing control system which is free of such inconvenience, wherein an electromagnetic coil is fixed to a casing non-rotatably mounted to an engine block so as to make a magnetic field or driving force produced by the coil act on a mounting-angle control mechanism through an air gap.

With the valve timing control system disclosed in the reference, however, the driving rotator and the follower rotator (particularly, the latter) are axially displaced together with the camshaft in accordance with engine operation, while the electromagnetic coil is fully fixed to the engine block through the casing, so that a driving force resulting from the coil is not stabilized during engine operation, often causing unstable control of valve timing. Specifically, the coil provides through the air gap a driving force to the mounting-angle control mechanism, which is mounted, together with the driving rotator and the flower rotator, to the camshaft to enable unitary axial displacement. Thus, when the camshaft is axially displaced in accordance with engine operation, the air gap varies with that displacement, leading to unstable driving force resulting from the electromagnetic coil.

SUMMARY OF THE INVENTION

It is, therefore, an object of the present invention to provide a valve timing control system for an internal combustion engine, which always allows desired control of valve timing regardless of axial displacement of the driving rotator and the follower rotator.

The present invention provides generally a system for controlling a valve timing in an internal combustion engine, which comprises: a driving rotator rotated by a crankshaft of the engine; a follower rotator provided to a camshaft of the engine, the follower rotator receiving power from the driving rotator; a stationary member; and an electromagnetic coil mounted to the stationary member, the electromagnetic coil producing a magnetic field to control an angle formed between the driving rotator and the follower rotator, the electromagnetic coil having rotation restricted and axial displacement allowed by the stationary member, the electromagnetic coil being engaged with one of the driving rotator and the follower rotator to enable rotation with respect to the one and axial displacement together therewith.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
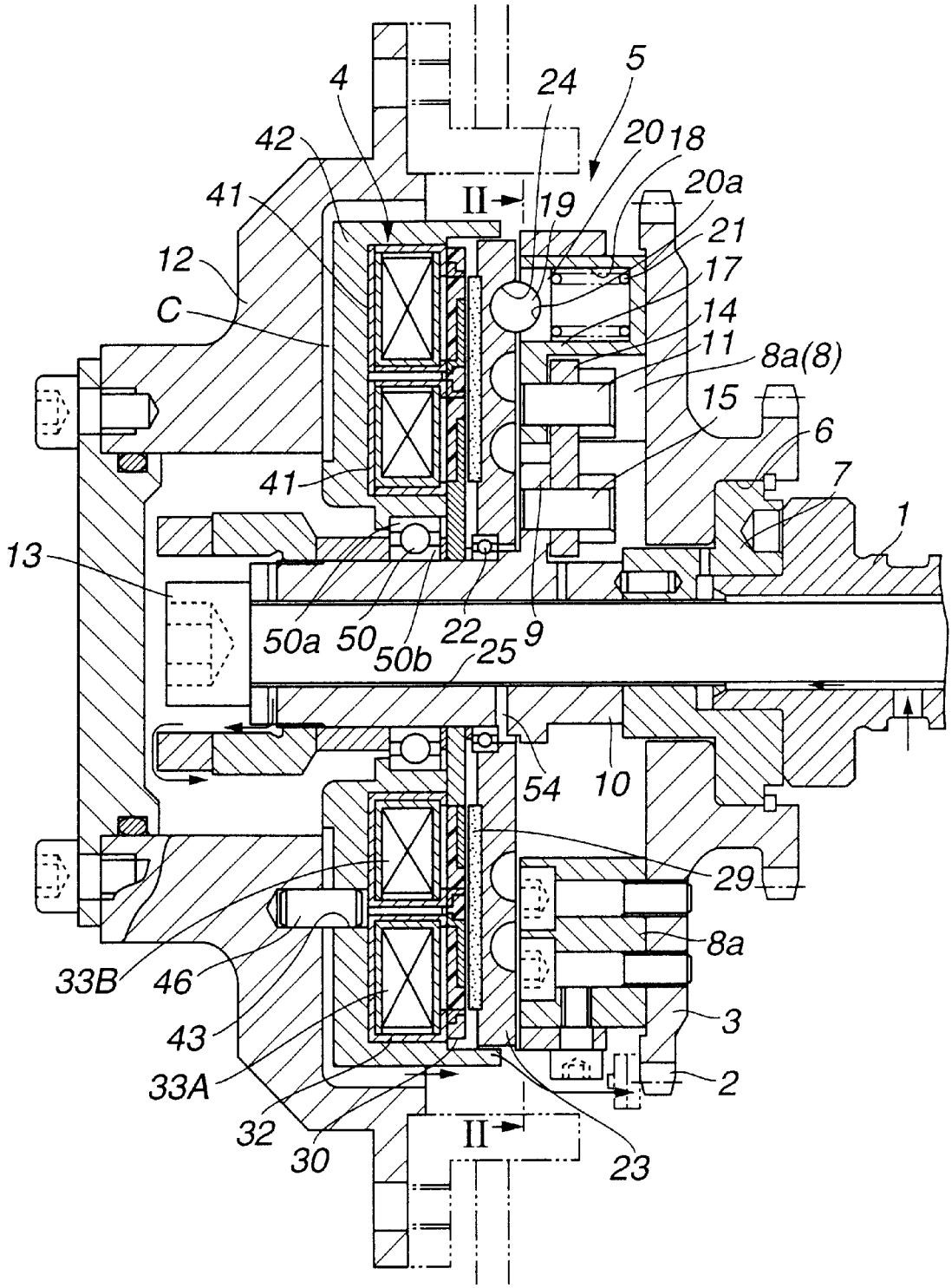
FIG. 1 is a longitudinal section showing an embodiment of a valve timing control system for an internal combustion engine according to the present invention.

Referring to the drawings, a description is made with regard to an embodiment of a valve timing control system for an internal combustion engine, wherein the present invention is applied to a power transfer system on the intake side of the engine. Note that the present invention can be applied to a power transfer system on the exhaust side of the engine.

Referring to FIG. 1, the valve timing control system comprises a camshaft 1 rotatably supported to a cylinder head, not shown, of an internal combustion engine, a driving plate or driving rotator 3 mounted to camshaft 1 at the front end to enable relative rotation as required and including at the outer periphery a timing sprocket 2 coupled to a crankshaft, not shown, through a chain, not shown, a mounting-angle control mechanism 5 disposed in front of camshaft 1 and driving plate 3, i.e. on the left as viewed in FIG. 1, to control a mounting angle formed between the two 1, 3, operating-force providing means 4 disposed in front of mounting-angle control mechanism 5 for operating mechanism 5, a valve timing control (VTC) housing or non-rotating or stationary member 12 attached to the front face of a cylinder head and rocker cover, not shown, to conceal the front face of operating-force providing means 4 and mounting-angle control mechanism 5 and their neighborhood.

Figure 2:
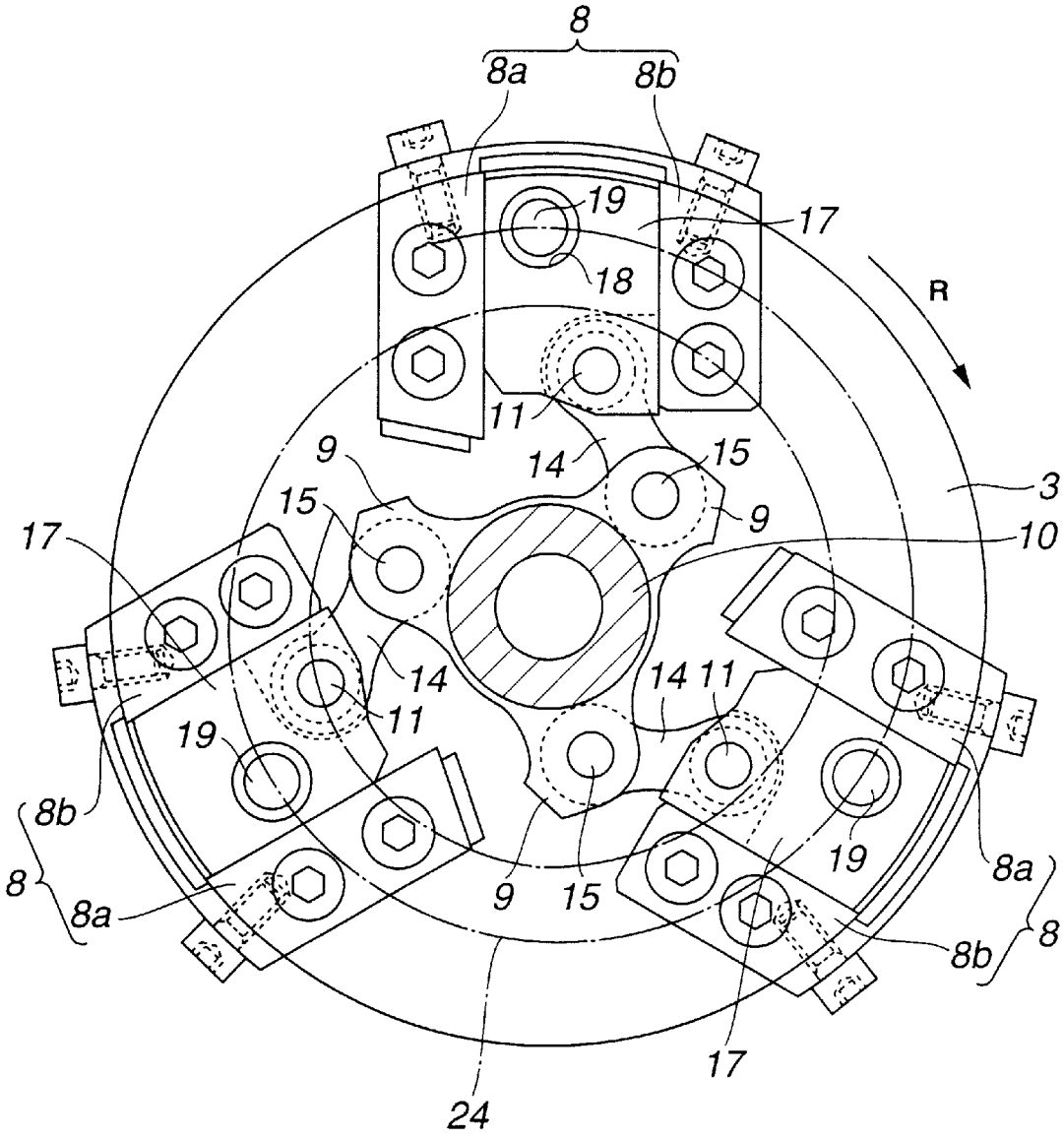
FIG. 2 is a sectional view taken along the line II—II in FIG. 1.

Driving plate 3 is formed like a disc having at the center a stepped support hole 6, which is rotatably supported by a flange ring 7 integrally connected to a front end of camshaft 1. Referring to FIG. 2, three radial guides 8 each comprising a pair of parallel guide walls 8*a*, 8*b* are circumferentially equidistantly mounted to the front face (the far side with respect to camshaft 1) of driving plate 3 along substantially the radial direction of plate 3. A roughly rectangular movable member 17 is slidably arranged between guide walls 8*a*, 8*b* of each radial guide 8.

A lever shaft or follower rotator 10 having radially protruding three levers 9 is arranged on the front side of flange ring 7, and is connected, together with flange ring 7, to camshaft 1 by a bolt 13. A coolant supply passage 25 is formed along the outer periphery of bolt 13 to extend from camshaft 1 through flange ring 7 to lever shaft 10, through which coolant is supplied to VTC housing 12. A link 14 has one end pivotally coupled to each lever 9 of lever shaft 10 by a pin 15, and another end pivotally coupled to each movable member 17 by a pin 11.

In the state of being guided by radial guide 8 as described above, movable member 17 is coupled to corresponding lever 9 of lever shaft 10 through link 14. Thus, when movable member 17 is displaced along radial guide 8 by application of an external force, driving plate 3 and lever shaft 10 perform relative rotation in the direction and by an angle corresponding to displacement of movable member 17 by the action of link 14.

A holding hole 18 is formed in the front face of the movable member 17 at a predetermined position, and a retainer 20 for holding a ball or engagement 19 and a coil spring 21 for biasing retainer 20 forward are slidably received therein. Retainer 20 has a semispherical recess 20*a* formed in the center of the front face to receive ball 19 in a free rolling way.

Figure 7:
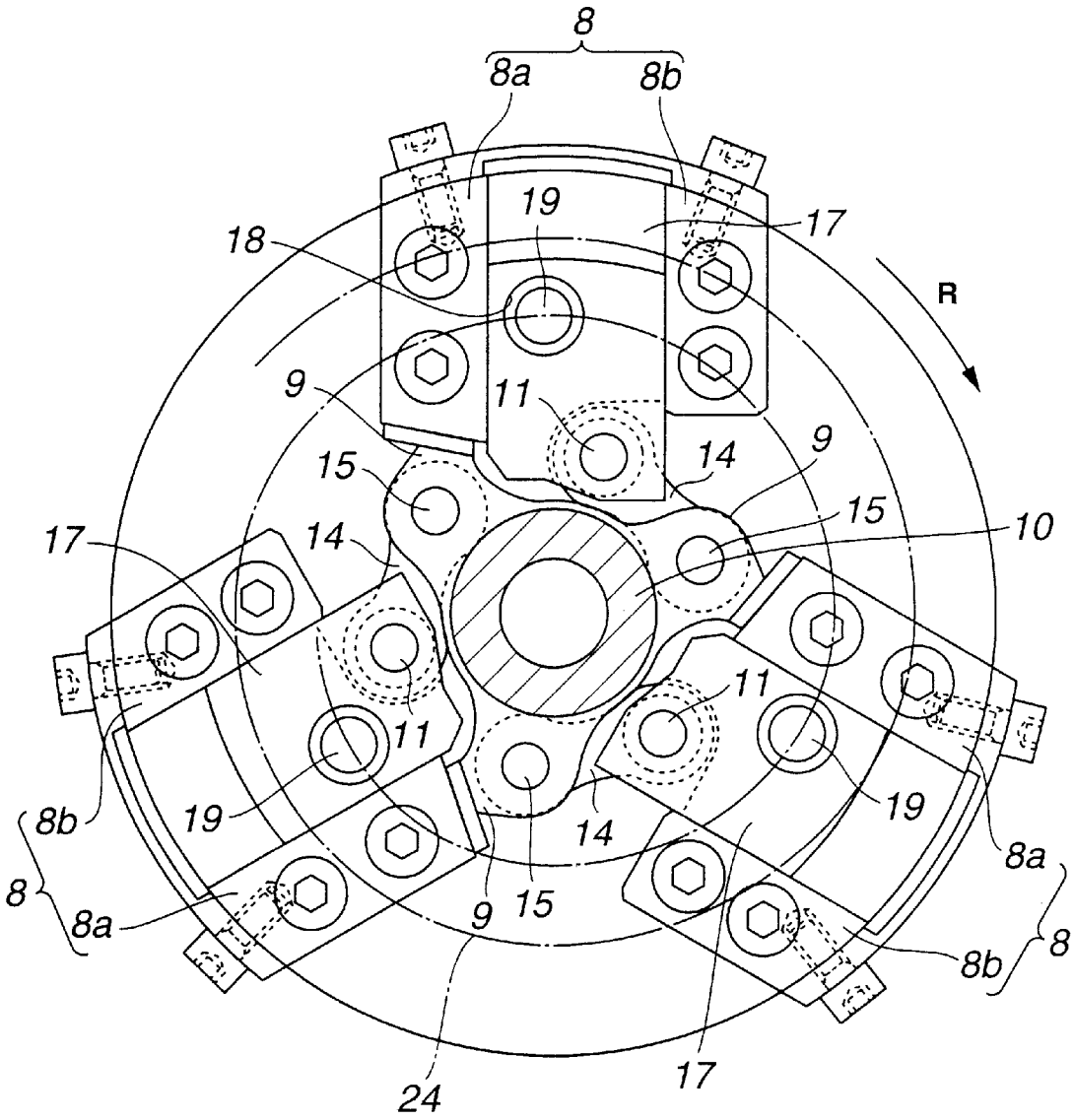
FIG. 7 is a view similar to FIG. 2, showing an operating state of the valve timing control system.
Figure 8:
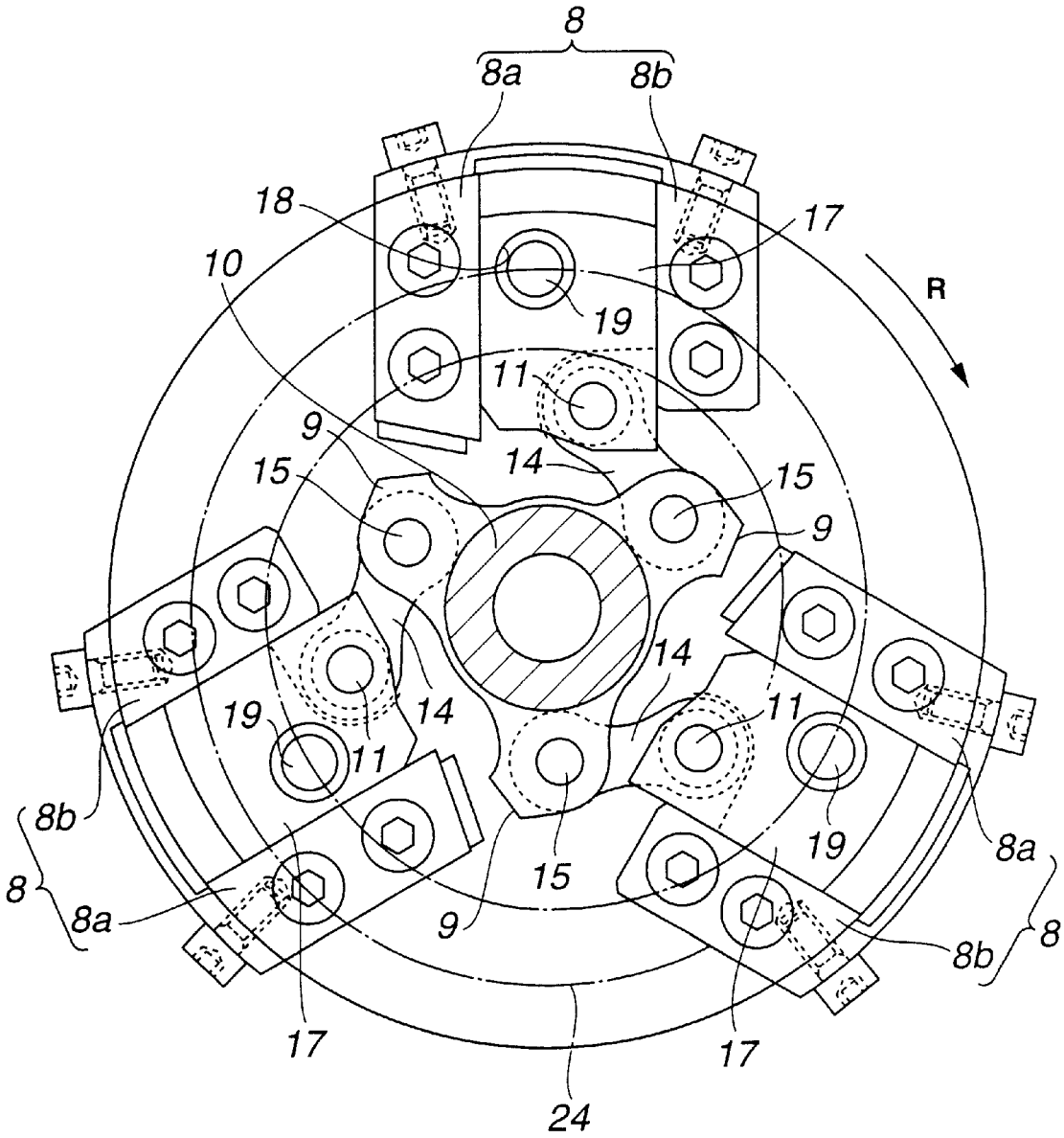
FIG. 8 is a view similar to FIG. 7, showing another operating state of the valve timing control system.

A roughly disc-like intermediate rotator 23 is supported on lever shaft 10 in front of the protruding position of lever 9 through a ball bearing 22. A spiral slot or guide 24 having semicircular section is formed in intermediate rotator 23 on the rear face, with which ball 19 of movable member 17 is engaged in a free rolling way. Referring to FIGS. 2 and 7–8 wherein only a center line of spiral slot 24 is shown, a spiral of spiral slot 24 is gradually reduced in diameter along a direction of rotation R of driving plate 3. Therefore, with ball 19 of movable member 17 engaged with spiral slot 24, when intermediate rotator 23 performs relative rotation in the lag direction with respect to driving plate 3, movable member 17 is moved radially inward along the spiral of the spiral slot 24, whereas when intermediate rotator 23 performs relative rotation in the advance direction, movable member 17 is moved radially outward.

In this embodiment, mounting-angle control mechanism 5 comprises radial guide 8 of driving plate 3, movable member 17, link 14, lever 9, spiral slot 24 of intermediate rotator 23, etc. When intermediate rotator 23 receives from operating-force providing means 4 a relative-rotation force with respect to camshaft 1, mounting-angle control mechanism 5 radially displaces movable member 17 through spiral slot 24, and amplifies the rotation force up to a set magnification through link 14 and lever 9, which is applied to driving plate 3 and camshaft 1.

Operating-force providing means 4 comprise an annular-plate permanent-magnet block 29 joined to the outer peripheral edge of the front face of intermediate rotator 23, i.e. the far side with respect to driving plate 3, a thin annular-plate yoke block 30 integrally connected to lever shaft 10, and an electromagnetic-coil block 32 arranged in VTC housing 12. Electromagnetic-coil block 32 comprises a plurality of electromagnetic coils 33A, 33B connected to a drive circuit, not shown, including an excitation circuit and a pulse distribution circuit, which is controlled by an electronic control unit (ECU), not shown. The ECU receives various input signals for engine operating conditions such as crank angle, cam angle, engine rpm, and engine load, to provide in accordance therewith control signals to the drive circuit.

Figure 4:
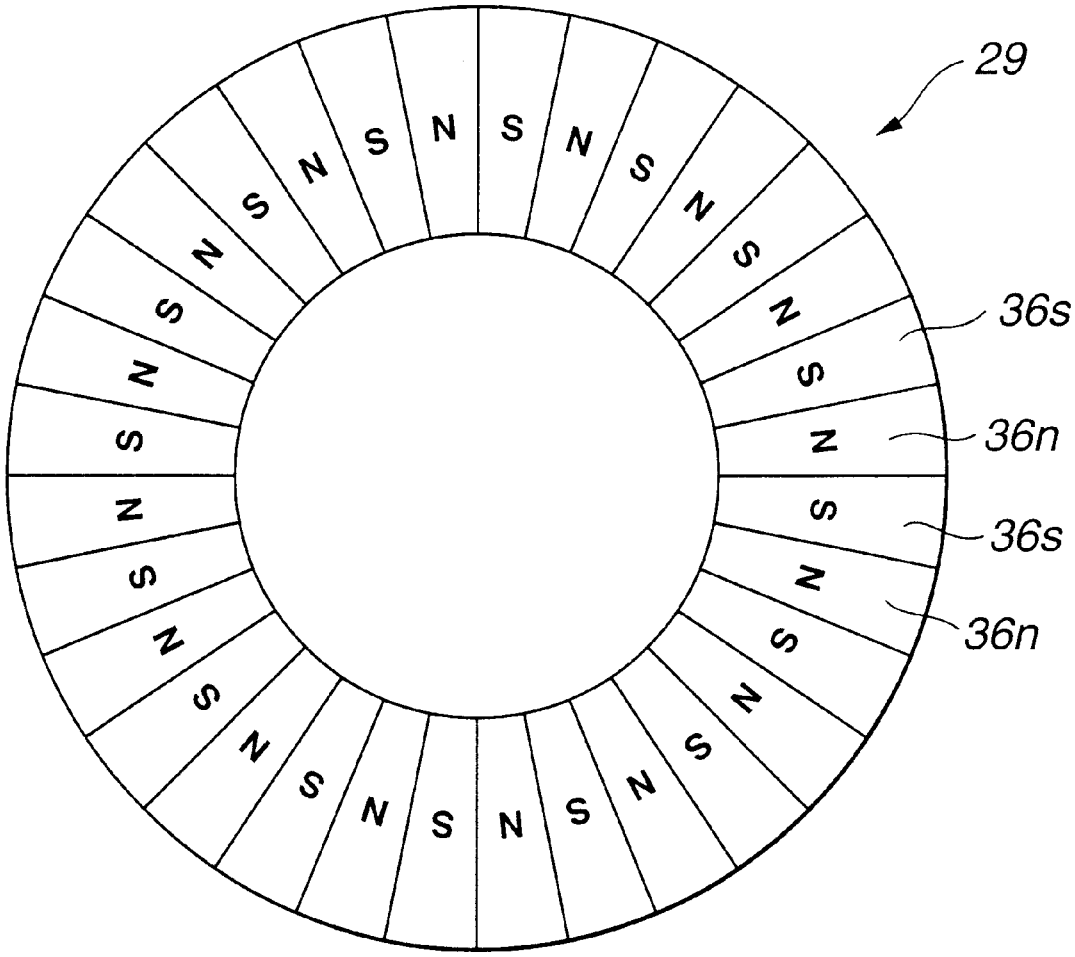
FIG. 4 is a front view showing a permanent-magnet block.

Referring to FIG. 4, permanent-magnet block 29 comprises a plurality of magnetic or N and S poles alternately disposed along the circumferential direction to radially extend from the surface perpendicular to the axial direction. In FIG. 4, the face of the N pole is designated by 36*n*, and the face of the S pole is designated by 36*s*.

Figure 3:
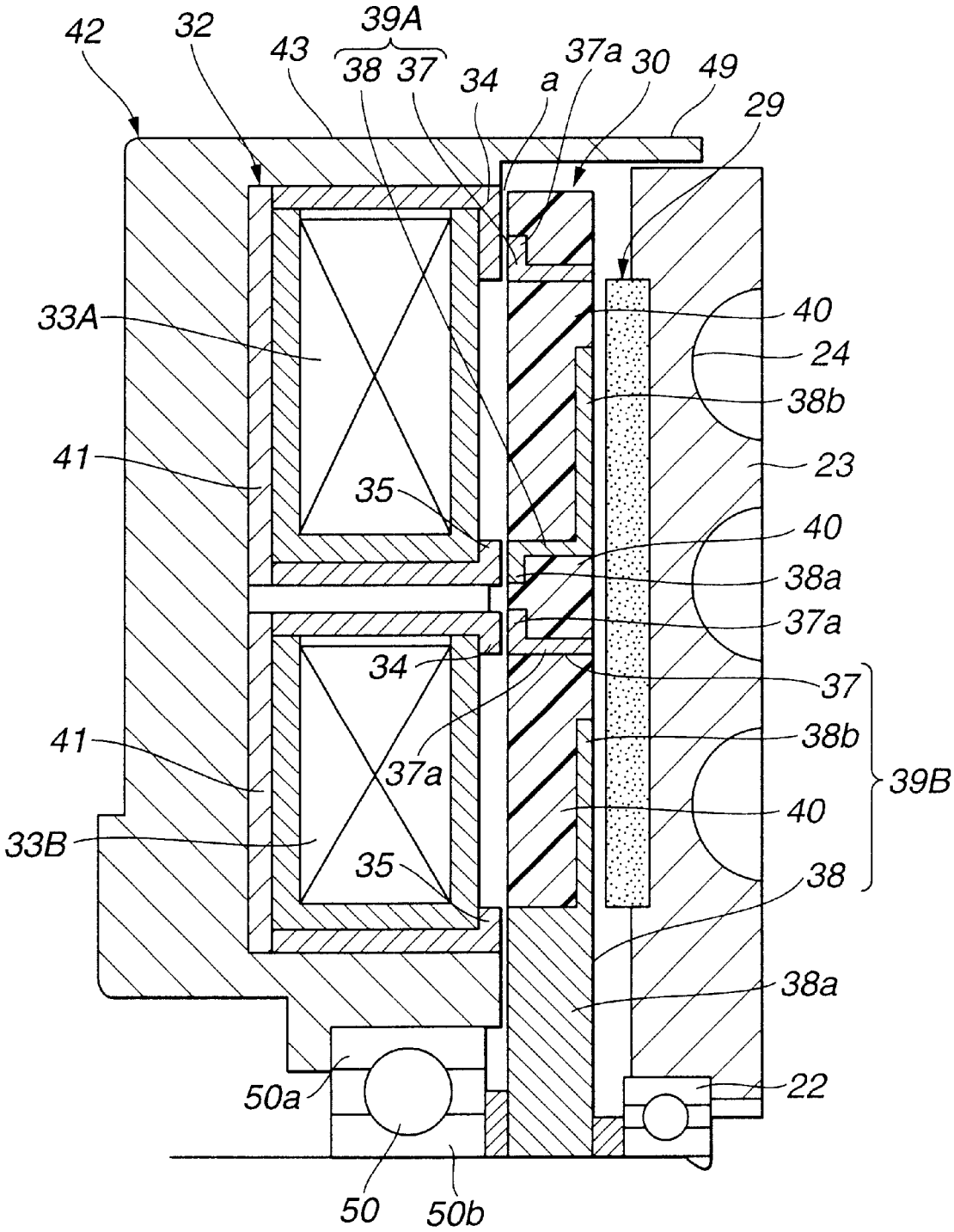
FIG. 3 is a fragmentary enlarged view of FIG. 1.
Figure 5:
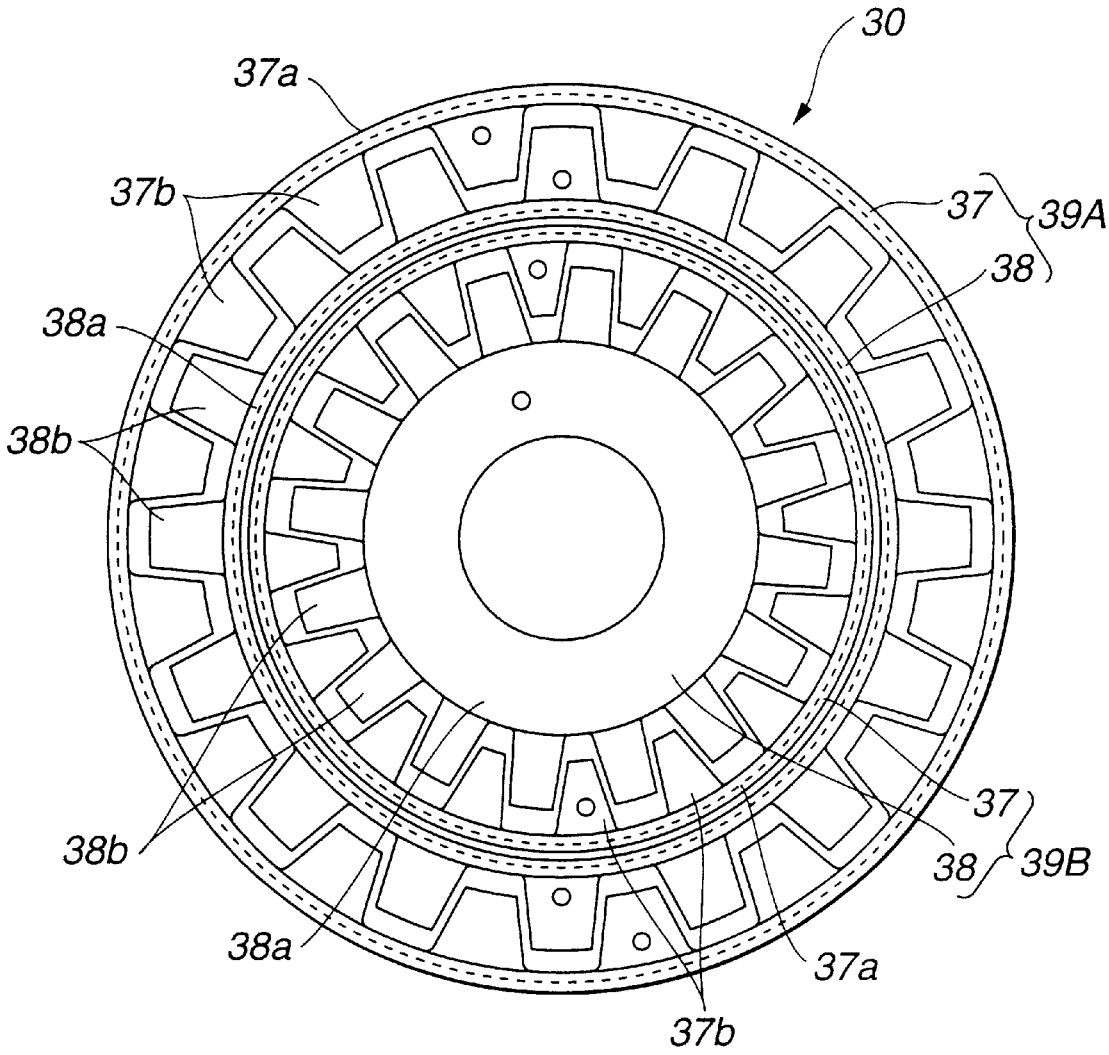
FIG. 5 is a view similar to FIG. 4, showing a yoke block with a filler resin not shown.
Figure 6:
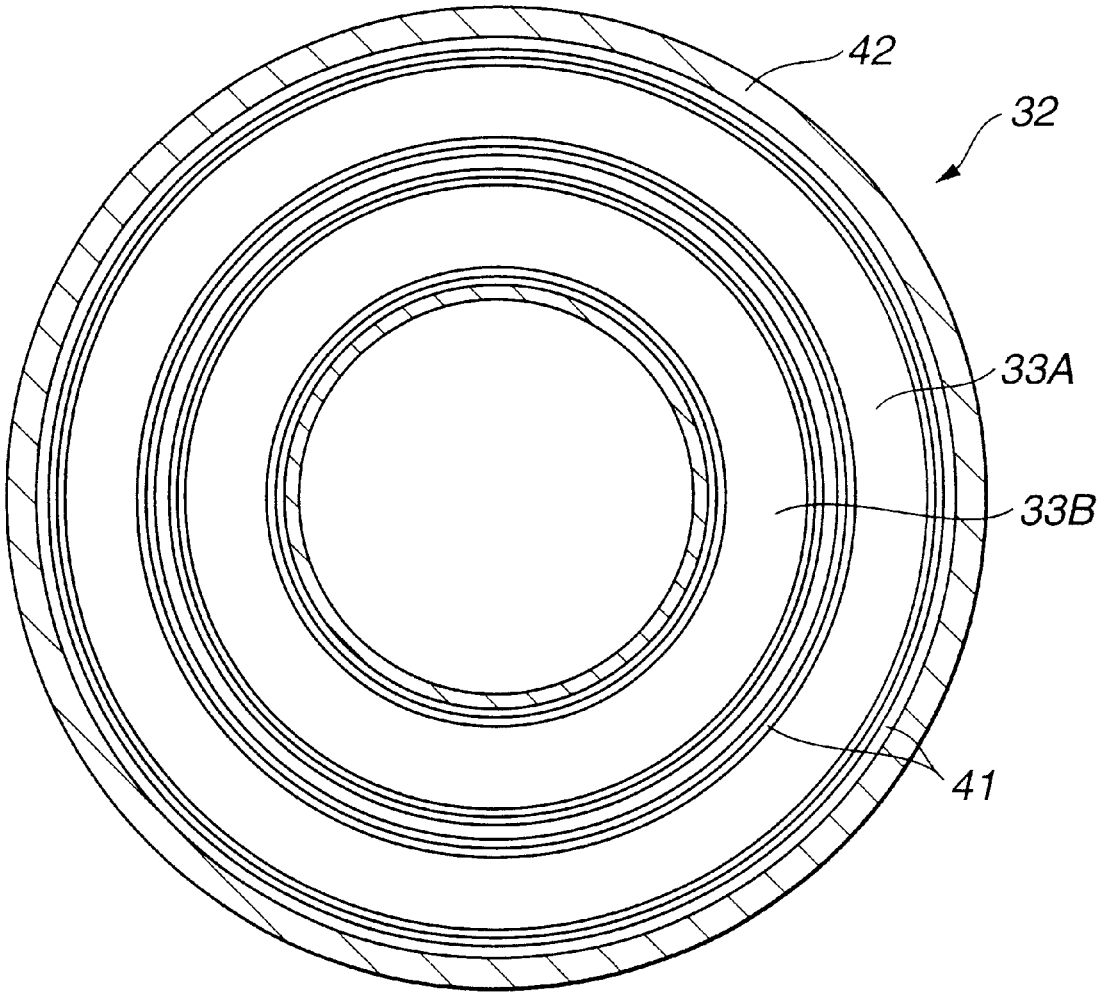
FIG. 6 is a cross section showing an electromagnetic-coil block.

Referring to FIGS. 3 and 5, yoke block 30 comprises two yokes 39A, 39B each including a pair of first and second pole-teeth rings 37, 38 and having an inner peripheral edge integrally connected to lever shaft 10.

First and second pole-teeth rings 37, 38 of each yoke 39A, 39B are formed out of a metallic material with high permeability, each comprising plate-ring bases 37*a*, 38*a* and a plurality of roughly trapezoidal pole teeth 37*b*, 38*b* extending radially inward or outward of bases 37*a*, 38*a* as shown in FIG. 5. In this embodiment, pole teeth 37*b*, 38*b* of each pole-teeth ring 37, 38 are arranged circumferentially equidistantly, and extend such that the tip faces the corresponding pole-teeth ring, i.e. the tip of first pole-teeth ring 37 faces radially inward, and the tip of second pole-teeth ring 38 faces radially outward. First and second pole-teeth rings 37, 38 are connected to each other by a resin material or insulator 40 so that pole teeth 37*b*, 38*b* are arranged circumferentially alternately and at regular pitches.

Yokes 39A, 39B constituting yoke block 30 are arranged radially outside and inside to form roughly a disc as a whole. Pole teeth 37*b*, 38*b* are disposed to have ¼ pitch shift along the circumferential direction.

As best seen in FIG. 3, yoke block 30 is disposed so that both side faces axially oppose permanent-magnet block 29 and electromagnetic-coil block 32. First and second pole-teeth rings 37, 38 of yokes 39A, 39B are formed to have junctions between pole teeth 37*b*, 38*b* and bases 37*a*, 38*a* bent appropriately so that ring bases 37*a*, 38*a* are located on the side of electromagnetic-coil block 32 or at the left as viewed in FIG. 3, and trapezoidal pole teeth 37*b*, 38*b* are located on the side of permanent-magnet block 29 or at the right as viewed in FIG. 3. Yokes 39A, 39B of yoke block 30 are connected to each other by resin material 40 in the same way as first and second pole-teeth rings 37, 38 of yokes 39A, 39B.

Electromagnetic-coil block 32 comprises two electromagnetic coils 33A, 33B disposed radially outside and inside, and yokes 41 disposed at the periphery of electromagnetic coils 33A, 33B for leading magnetic flux produced by electromagnetic coil 33A to magnetic entrances 34, 35 close to yoke block 30. Yokes 41 for electromagnetic coils 33A, 33B are formed out of a material with high permeability such as ferrous metal.

As shown in FIG. 3, magnetic entrances 34, 35 for electromagnetic coils 33A, 33B face ring bases 37*a*, 38*a* of yokes 39A, 39B of yoke block 30 through an axial air gap "a", respectively. Therefore, when electromagnetic coils 33A, 33B are excited to produce a magnetic field in a predetermined direction, magnetic induction occurs in yokes 39A, 39B of yoke block 30 through air gap "a", resulting in emergence of the magnetic poles in pole teeth 37, 38 of yokes 39A, 39B in accordance with the direction of the magnetic field.

The magnetic field produced by electromagnetic coils 33A, 33B is switched in sequence in predetermined patterns with respect to input of pulses from the drive circuit, thus moving by 4/1 pitch movement of the magnetic poles of pole teeth 37*b*, 38*b* facing pole faces 36*n*, 36*s* along the circumferential direction. Therefore, intermediate rotator 23 follows movement of the magnetic poles along the circumferential direction of yoke block 30, and performs relative rotation with respect to lever shaft 10.

Electromagnetic-coil block 32 substantially in its entirety except magnetic entrances 34, 35 of yokes 41 is covered and held by a holding block 42 formed out of a non-magnetic material such as aluminum, and is mounted to VTC housing 12 therethrough. Holding block 42 is formed to envelop the outer periphery of yoke 41 on the side of radially outside electromagnetic coil 33A, the inner periphery of yoke 41 on the side of radially inside electromagnetic coil 33B, and far-side end faces of yokes 41 with respect to magnetic entrances 34, 35. A bottom wall of holding block 42 is locked and fixed to an inner face of the end wall of VTC housing 12 through an engaging pin or rotation restricting member 46.

Engaging pin 46 is formed out of a non-magnetic material such as aluminum, and is arranged to protrude from the inner face of an end wall of VTC housing 12 as shown in FIG. 1. Engaging pin 46 is engaged with a pin hole 43 formed in the bottom wall of holding block 42 with a slight clearance therebetween to allow axial movement of holding block 42 with respect to VTC housing 12.

A ball bearing 50 is arranged at the inner periphery of holding block 42, through which holding block 42 is rotatably engaged with lever shaft 10. Ball bearing 50 includes an outer race 50*a* fixed to holding block 42 and an inner race 50*b* fixed to lever shaft 10 so as to enable unitary axial and radial displacement of holding block 42 and lever shaft 10 while allowing rotation of lever shaft 10 with respect to holding block 42. An axial clearance "c" is formed between the bottom wall of holding block and the inner end face of VTC housing 12 to allow axial displacement of holding block 42 within the range of clearance "c".

In this embodiment, the valve timing control system is constructed as described above, so that at the time of start of the engine and during idle running, keeping in advance the mounting angle of driving plate 3 and lever shaft 10 on the maximum lag-angle side allows the phase of rotation of the crankshaft and camshaft 1, i.e. opening and closing timing of the engine valve, to be on the maximum lag-angle side, achieving stabilized engine rotation and improved fuel consumption.

From this state, when engine operation proceeds normal running, and the ECU provides a command to the drive circuit of electromagnetic-coil block 32 so as to change the phase of rotation to the maximum advance-angle side, electromagnetic-coil block 32 switches a produced magnetic field in predetermined patterns in accordance with the command, making maximum relative rotation of permanent-magnet block 29 together with intermediate rotator 23 in the lag direction. Thus, movable member 17 engaged with spiral slot 24 by ball 19 performs maximum radially inward displacement along radial guide 8 as shown in FIG. 7, changing the mounting angle of driving plate 3 and lever shaft 10 through link 14 and lever 9 to the maximum advance-angle side. As a result, the phase of rotation of the crankshaft and camshaft 1 is changed to the maximum advance- angle side, achieving a power increase of the engine.

On the other hand, from this state, the ECU provides a command to change the phase of rotation to the maximum lag-angle side, electromagnetic-coil block 32 switches a produced magnetic field in reversed patterns to make maximum relative rotation of intermediate rotator 23 in the advance direction, performing maximum radially outward displacement of movable member 17 engaged with spiral slot 24 along radial guide 8 as shown in FIG. 2. Thus, movable member 17 performs relative rotation of driving plate 3 and lever shaft 10 through link 14 and lever 9 to change the phase of rotation of the crankshaft and camshaft 1 to the maximum lag-angle side.

In this embodiment, the phase of rotation of the crankshaft and camshaft 1 is changed to the maximum advance-angle position or the maximum lag-angle position. Optionally, referring to FIG. 8, the phase of rotation can be changed to any position by control of the ECU, such as middle position between the maximum advance-angle position and the maximum lag-angle position.

Camshaft 1 can axially be displaced during engine operation. In that event, driving plate 3 and lever shaft 10 mounted to camshaft 1 at the front end are axially displaced together with camshaft 1. Holding block 42 for covering and holding electromagnetic coils 33A, 33B and yoke 41 is allowed by engagement of engaging pin 46 and pin hole 43 to axially be displaced with respect to VTC housing 12, and is enabled to perform unitary displacement with respect to lever shaft 10 through ball bearing 50. Thus, when lever shaft 10 is displaced axially, holding block 42 is axially displaced within clearance "c" in accordance with the displacement. As a result, even in the event of axial displacement of camshaft 1, air gap "a" between electromagnetic coils 33A, 33B and yoke block 30 is maintained constant. Therefore, a driving force produced by electromagnetic coils 33A, 33B is not affected by axial displacement of camshaft 1, achieving always stable valve timing control.

In the illustrative embodiment, engaging pin 46 is arranged to protrude from VTC housing 12, and pin hole 43 with which pin 46 is engaged is formed in holding block 42. The converse is also possible, i.e. engaging pin 46 is arranged to protrude from holding block 42, and pin hole 43 is formed in VTC housing 12. Moreover, the rotation restricting member is not limited to engaging pin 12, but may be a plate member or a block member.

Further, in the illustrative embodiment, holding block 42 is supported to lever shaft 10 through ball bearing 50, resulting in possible reduction in frictional resistance of lever shaft 10 during rotation. The bearing for that portion is not limited to ball bearing 50, but may be a needle bearing or a slide bearing. Note that when adopting ball bearing 50, a single bearing can restrict both axial displacement and radial displacement, leading to possible reduction in number of parts and thus in manufacturing cost. The bearing interposed between holding block 42 and lever shaft 10 is, preferably, in the form of a sealed bearing, such as sealed ball bearing, with lubricant charged therein, which can enhance the bearing performance due to presence of lubricant, and maintain it over the long term by preventing wear particles and the like from entering the bearing.

Furthermore, in the illustrative embodiment, electromagnetic coils 33A, 33B are mounted to VTC housing 12 through holding block 42 formed out of a non-magnetic material. Thus, even when VTC housing 12 is formed out of a magnetic material such as ferrous material, there is no occurrence of a leakage of magnetic flux produced by electromagnetic coils 33A, 33B to VTC housing 12. In the illustrative embodiment, engaging pin 46 or rotation restricting member is also formed out of a non-magnetic material, resulting in no occurrence of a leakage of magnetic flux produced by electromagnetic coils 33A, 33B to VTC housing 12 through pin hole 43.

Still further, in the illustrative embodiment, the driving rotator includes driving plate 3 with timing sprocket 2. Optionally, the driving rotator may include a timing pulley to which rotation is transferred through a belt, and a gear directly meshed with a gear of other shaft. Moreover, operating-force providing means 4 are not limited to the construction that relative rotation of yoke block 30 and permanent-magnet block 29 is performed by switching a produced magnetic field in predetermined patterns, but may be the construction that rotation of intermediate rotator 23 is increased and decreased by the action of a braking force or electromagnetic force or directly by a motor unit.

Moreover, a material of holding block 42 may be copper in place of aluminum.

As described above, according to the present invention, the electromagnetic coil is axially displaced upon occurrence of axial displacement of the driving rotator and the follower rotator, an air gap between the electromagnetic coil and the member on the side of the driving rotator and the follower rotator can be maintained always constant, obtaining stable driving force resulting from the coil. Therefore, the present invention can always provide desired stable control of valve timing.

Having described the present invention with regard to the preferred embodiment, it is noted that the present invention is not limited thereto, and various changes and modifications can be made without departing from the scope of the present invention.

The entire contents of Japanese Patent Application P2001-246382 filed Aug. 15,2001 are incorporated hereby by reference.

What is claimed is:

1. A system for controlling a valve timing in an internal combustion engine, comprising:

a driving rotator rotated by a crankshaft of the engine;

a follower rotator provided to a camshaft of the engine, the follower rotator receiving power from the driving rotator;

a stationary member; and an electromagnetic coil mounted to the stationary member, the electromagnetic coil producing a magnetic field to control an angle formed between the driving rotator and the follower rotator, the electromagnetic coil having rotation restricted and axial displacement allowed by the stationary member, the electromagnetic coil being engaged with one of the driving rotator and the follower rotator to enable rotation with respect to the one and axial displacement together therewith.

2. The system as claimed in claim 1, further comprising a restricting member arranged between the stationary member and the electromagnetic coil, the restricting member restricting relative rotation of the stationary member and the electromagnetic coil and allowing axial displacement thereof.

3. The system as claimed in claim 1, wherein an axial clearance is formed between the stationary member and a block on the side of the electromagnetic coil.

4. The system as claimed in claim 1, further comprising a bearing through which the electromagnetic coil is engaged with one of the driving rotator and the follower rotator.

5. The system as claimed in claim 4, wherein the bearing comprises a ball bearing.

6. The system as claimed in claim 4, wherein the bearing comprises a sealed bearing with lubricant charged therein.

7. The system as claimed in claim 1, further comprising a holding block through which the electromagnetic coil is mounted to the stationary member.

8. The system as claimed in claim 7, wherein the holding block is formed out of a non-magnetic material.

9. The system as claimed in claim 2, wherein the restricting member is formed out of a non-magnetic material.

10. A system for controlling a valve timing in an internal combustion engine, comprising:

a driving rotator rotated by a crankshaft of the engine;

a follower rotator provided to a camshaft of the engine, the follower rotator receiving power from the driving rotator;

a radial guide provided to one of the driving rotator and the follower rotator;

an intermediate rotator arranged to enable rotation with respect to the driving rotator and the follower rotator, the intermediate rotator having a spiral guide on a face opposite to the radial guide;

a movable member engaged with the radial guide, the movable member being movable radially, the movable member having an axial end with an engagement engaged with the spiral guide;

a link which pivotally couples a portion of another of the driving rotator and the follower rotator distant from a center of rotation thereof to the movable member;

a stationary member; and an electromagnetic coil mounted to the stationary member, the electromagnetic coil producing a magnetic field to rotate the intermediate rotator with respect to the driving rotator and the follower rotator, the produced magnetic field causing radial displacement of the movable member engaged with the spiral guide along the radial guide, the radial displacement being converted into relative rotation of the driving member and the follower rotator through the link, the electromagnetic coil having rotation restricted and axial displacement allowed by the stationary member, the electromagnetic coil being engaged with one of the driving rotator and the follower rotator to enable rotation with respect to the one and axial displacement together therewith.

11. The system as claimed in claim 10, further comprising:

a permanent-magnet block mounted to the intermediate rotator, the permanent-magnet block having magnetic poles alternately emerging along a circumferential direction;

a yoke block comprising at least one yoke including first and second rings each having a plurality of pole teeth facing a pole face of the permanent-magnet block, the pole teeth of the first and second rings being arranged alternately and shifted by a predetermined pitch in the circumferential direction, the yoke block in its entirety being provided to the another of the driving rotator and the follower rotator; and an electromagnetic-coil block comprising the electromagnetic coil corresponding to the at least one yoke of the yoke block, the electromagnetic-coil block being fixed to the stationary member such that a magnetic entrance of the electromagnetic coil faces the first and second rings of the at least one yoke through an air gap, the magnetic field produced by the electromagnetic coil being changed in predetermined patterns to make relative rotation of the permanent-magnet block and the yoke block.

12. A system for controlling a valve timing in an internal combustion engine, comprising:

a driving rotator rotated by a crankshaft of the engine;

a follower rotator provided to a camshaft of the engine, the follower rotator receiving power from the driving rotator;

a radial guide provided to one of the driving rotator and the follower rotator;

an intermediate rotator arranged to enable rotation with respect to the driving rotator and the follower rotator, the intermediate rotator having a spiral guide on a face opposite to the radial guide;

a movable member engaged with the radial guide, the movable member being movable radially, the movable member having an axial end with an engagement engaged with the spiral guide;

a link which pivotally couples a portion of another of the driving rotator and the follower rotator distant from a center of rotation thereof and the movable member;

a stationary member; and an electromagnetic coil mounted to the stationary member, the electromagnetic coil producing a magnetic field to rotate the intermediate rotator with respect to the driving rotator and the follower rotator, the produced magnetic field causing radial displacement of the movable member engaged with the spiral guide along the radial guide, the radial displacement being converted into relative rotation of the driving member and the follower rotator through the link, the electromagnetic coil having rotation restricted and axial displacement allowed by the stationary member, the electromagnetic coil being engaged with one of the driving rotator and the follower rotator to enable rotation with respect to the one and axial displacement together therewith, the electromagnetic coil producing an electromagnetic force which operates as braking force to increase and decrease rotation of the intermediate rotator.

13. The system as claimed in claim 2, wherein the restricting member comprises an engaging pin provided to one of the stationary member and the electromagnetic coil and a pin hole formed in another of the stationary member and the electromagnetic coil, the engaging pin being axially movably arranged through the pin hole.

* * * * *